US006098284A

United States Patent [19]

Price

[11] Patent Number: 6,098,284

[45] Date of Patent: Aug. 8, 2000

[54] METHOD OF RETENTIVELY ATTACHING A RIBBON CABLE CONNECTOR TO A DEVICE

[75] Inventor: Mark Price, Caldwell, Id.

[73] Assignee: Micron Electronics, Inc., Boise, Id.

[21] Appl. No.: 08/988,061

[22] Filed: Dec. 10, 1997

[51] Int. Cl.[7] ..... H01R 43/04

[52] U.S. Cl. ..... 29/861; 29/749; 29/753; 29/755; 29/759; 29/857; 439/171; 439/172; 439/404; 439/405

[58] Field of Search ..... 29/749, 753, 861, 29/857, 721, 720, 755, 715, 759; 439/404, 405, 171, 172, 189

[56] References Cited

U.S. PATENT DOCUMENTS 4,971,571 11/1990 Puemer .

5,336,103 8/1994 Herboldsheimer .

FOREIGN PATENT DOCUMENTS 0122842 10/1984 European Pat. Off. .

*Primary Examiner*—Lee Young
*Assistant Examiner*—Binh-An Nguyen
*Attorney, Agent, or Firm*—Knobbe, Martens, Olson & Bear LLP

[57] ABSTRACT

Disclosed is a method of releasably attaching a ribbon cable to a hardware device. In one embodiment, the method comprises attaching the ribbon cable to a ribbon cable connector having an internal retaining mechanism, coupling the ribbon cable connector to a mating connector on the hardware device, and actuating the internal retaining mechanism so that the internal retaining mechanism engages the mating connector to thereby inhibit the mating connector from uncoupling from the hardware device. The method allows a user to easily and securely attach a ribbon cable to a hardware device.

20 Claims, 2 Drawing Sheets

METHOD OF RETENTIVELY ATTACHING A RIBBON CABLE CONNECTOR TO A DEVICE

RELATED APPLICATIONS

The subject matter of U.S. Patent Application entitled "RETENTIVE RIBBON CABLE CONNECTOR," filed DEC. 10, 1999, Application No. 08/987,892, and having attorney Docket No. MPATENT.058A is related to this application.

BACKGROUND OF THE INVENTION

1. Field of the Invention

The invention relates to a method of connecting ribbon cable connectors to a device. More particularly, the invention relates to a method of retentively connecting a ribbon cable to a hardware device.

2. Description of the Related Art

Ribbon cables are flat, flexible cables containing a plurality of electrical wires that are aligned in a row. These cables are commonly used to establish a communication path between two computer devices, such as between a computer motherboard and a floppy disk drive. This is accomplished by using a ribbon cable connector, which is a connecting device that is attached to both ends of the cable. The ribbon cable connector removably connects onto a mounting port on each of the hardware devices and thereby electrically couples the electrical wires in the cable to the hardware devices. In a typical hardware device, the mounting port comprises a set of aligned teeth or pins that extend outward from the hardware device in a predetermined pattern.

A standard ribbon cable connector includes a plurality of female slots that are arranged in the same predetermined pattern as the pins or teeth on the hardware device. The pin slots are sized to slidingly receive the pins on the hardware device. A user connects the ribbon cable to the hardware device by inserting the pins into the corresponding pin slots in the ribbon cable connector. After the pins have been inserted, the ribbon cable connector remains connected to the hardware device via a friction fit between the pins and the female slots in the connector.

Unfortunately, there are certain drawbacks associated with current ribbon cable connectors, particularly regarding the maintenance of a secure connection between the pins of the hardware device and the pin slots in the ribbon cable connector. For example, the friction fit between the cable connector and the pins on the hardware device is often insufficient to retain the cable connector attached to the pins. As a result, over time, the ribbon cable often gradually becomes loosened from the hardware device, which may have an adverse effect on the electrical communication path between the two hardware devices connected by the ribbon cable. This is highly undesirable.

In an attempt to solve this problem, some computer assemblers have attached movable shrouds to the mounting port on the hardware device. After an installer inserts the pins into the pin slots on the cable connector, the installer snaps the shrouds over the cable connector. The shrouds thereby inhibit relative movement between the cable connector and the hardware device. Unfortunately, while shrouds provide a more secure fit between the cable connector and the pins of a hardware device, they are impractical in use as they require a user to re-fit the standard mounting port on the hardware device with the shrouds. This may be costly and time consuming.

Some installers have also used alligator clips to more securely retain the cable connector to the pins of the hardware device. However, the use of alligator clips has been shown to be tedious and unreliable. Additionally, alligator clips are not practical if a supply of such clips is not readily available.

There is, therefore, a need for a ribbon cable connector that is configured to be easily and securely retained to a mounting port on a hardware device. The ribbon cable connector should not require the hardware device to be re-fitted with external connecting mechanisms, such as shrouds or alligator clips, and should be capable of being used with existing mounting port designs.

SUMMARY OF THE INVENTION

The aforementioned needs are satisfied by the present invention. In one aspect of the invention, there is disclosed a method of releasably attaching a ribbon cable to a hardware device. The method comprises attaching the ribbon cable to a ribbon cable connector having an internal retaining mechanism, coupling the ribbon cable connector to a mating connector on the hardware device, and actuating the internal retaining mechanism so that the internal retaining mechanism engages the mating connector to thereby inhibit the mating connector from uncoupling from the hardware device.

In another aspect of the invention, there is disclosed a method of releasably attaching a ribbon cable to a mating connector on a hardware device. The method comprises attaching the ribbon cable to a ribbon cable connector having at least one slot sized to receive the mating connector and an internal retaining mechanism configured to engage the mating connector when the mating connector is inserted into the slot. The method further comprises inserting the mating connector of the hardware device into the at least one slot on the ribbon cable connector, and actuating the internal retaining mechanism so that the internal retaining mechanism engages the mating connector in the slot to thereby inhibit the mating connector from moving out of the slot.

In yet another aspect of the invention, there is disclosed a method of retentively coupling a ribbon cable to a hardware device. The method comprises attaching the ribbon cable to a ribbon cable connector configured to couple to the hardware device wherein the ribbon cable connector includes a slot dimensioned to receive the mating connector on the hardware device and an internal retaining rod configured to engage the mating connector when the mating connector is inserted into the slot. The method further comprises inserting the mating connector on the hardware device into the slot so that the internal mating mechanism engages the mating connector to thereby inhibit the mating connector from moving out of the slot.

BRIEF DESCRIPTION OF THE DRAWINGS

These and other features of the invention will now be described with respect to the drawings, which are intended to illustrate and not to limit the invention and in which.

DETAILED DESCRIPTION OF THE INVENTION

Figure 1:
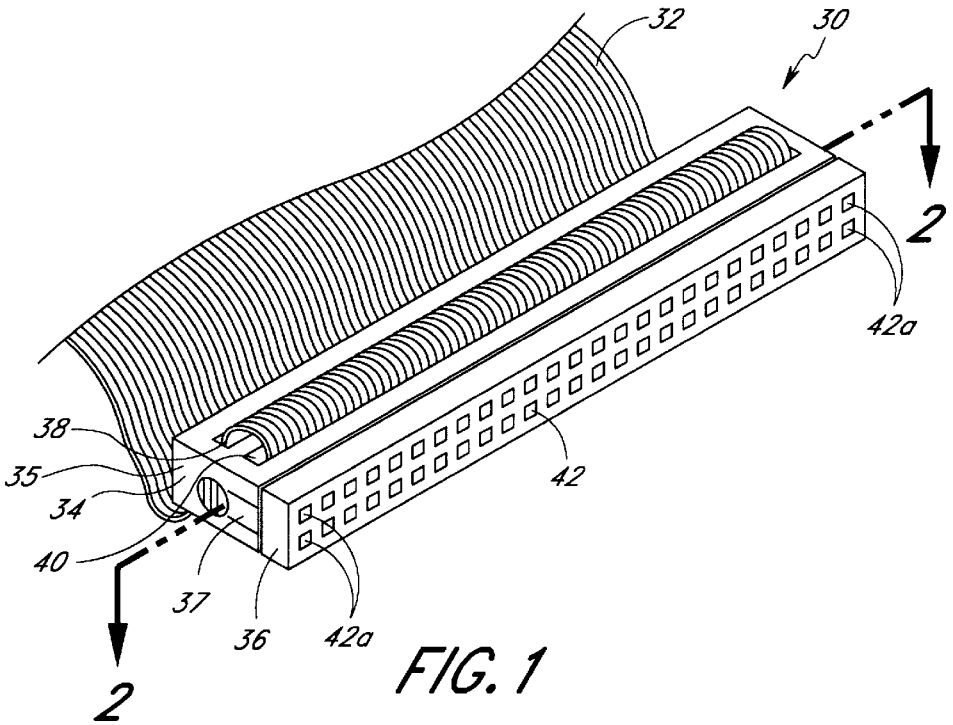
FIG. 1 is a perspective view of a ribbon cable attached to a ribbon cable connector configured in accordance with one embodiment of the invention.

FIG. 1 is a perspective view of a ribbon cable connector 30 attached to a ribbon cable 32. The ribbon cable connector 30 includes an internal retaining mechanism that allows a user to easily and securely couple the ribbon cable 32 to any of a wide variety of hardware devices, as described in detail below. As shown, the ribbon cable 32 comprises a plurality of wires that are aligned in a row and enclosed by a flexible plastic covering, as is well-known in the art. In one embodiment, the ribbon cable 32 may be attached to a 32 pin floppy connector, a 40 pin IDE connector, or a 50 pin SCSI connector. It will be appreciated by those skilled in the art, however, that the ribbon cable 32 may also be securely attached to any of a wide variety of devices using the ribbon cable connector 30. The ribbon cable connector 32 and associated hardware device are described herein in the context of a pin connection. However, those skilled in the art will appreciate that the inventive features of the ribbon cable connector 30 are applicable to a wide variety of mating connections, such as blade connections.

With reference to FIG. 1, the ribbon cable connector 30 is elongated in shape and comprises a rectangular housing 34 having opposed sides 35 and defining a rectangular cavity therein. A rectangular coupling member 36 is slidably mounted within the housing 34. A locking mechanism comprising a pair of movable tabs 37 is located on each of the sides 35 of the housing 34. Each of the tabs 37 is elongated and has a first end integrally attached to the housing 34 and a free end that is inwardly movable relative to the housing 34. For convenience, the tabs are referred to collectively and individually using the reference numeral 37. In the illustrated embodiment, only one of the tabs 37 is visible, although it will be appreciated that the tabs 37 are identical mirror images of one another.

When pressed by a user, the tabs 37 enables the housing 34 to slide relative to the coupling member 36 to thereby operate the internal retaining mechanism of the ribbon cable connector 30, as described in more detail below. A user presses the tab 37 and slides the housing 34 outward from the coupling member 36 (or vice-versa) to release the internal retaining mechanism from engagement with the pins of a hardware device. The user then slides the housing 34 back into the coupling member 36 to re-engage the internal retaining mechanism with the pins of the hardware device. The structure and process associated with the tabs 37 and the internal retaining mechanism is described more fully below with respect to FIGS. 3–5.

The ribbon cable 32 may be attached to the ribbon cable connector 30 in any of a wide variety of manners. In the embodiment shown in FIG. 1, the housing 34 includes a first elongated aperture 38 for receiving the end of the ribbon cable 32. As shown, the housing 34 also includes a second elongated aperture 40 for receiving the end of the cable 32 after it has been inserted into and passed through the first elongated aperture 38. The end of the cable 32 extends through the second elongated aperture 40 and is securely retained within the housing 34 by connection to electrical contacts, in a well known manner.

As shown in FIG. 1, a plurality of apertures 42 are located in the front face of the coupling member 36 of the ribbon cable connector 30. Each of the apertures 42 communicates with a corresponding pin slot 44 (FIG. 2) that extends into the coupling member 36. The apertures 42 and pins slots 44 are arranged in two rows with a peripheral aperture 42*a* and a peripheral pin slot 44*a* located at the end of each row. The apertures 42 and pin slots 44 are sized to receive a mating connector such as a set of hardware pins (not shown) that are sized and spaced according to the size and spacing of the apertures 42 and pin slots 44. Alternately, the apertures 42 and slots 44 could be replaced with a single elongated aperture and a corresponding elongated slot that are sized to receive a mating connector such as a blade or tooth structure, as is known to those skilled in the art.

Figure 2:
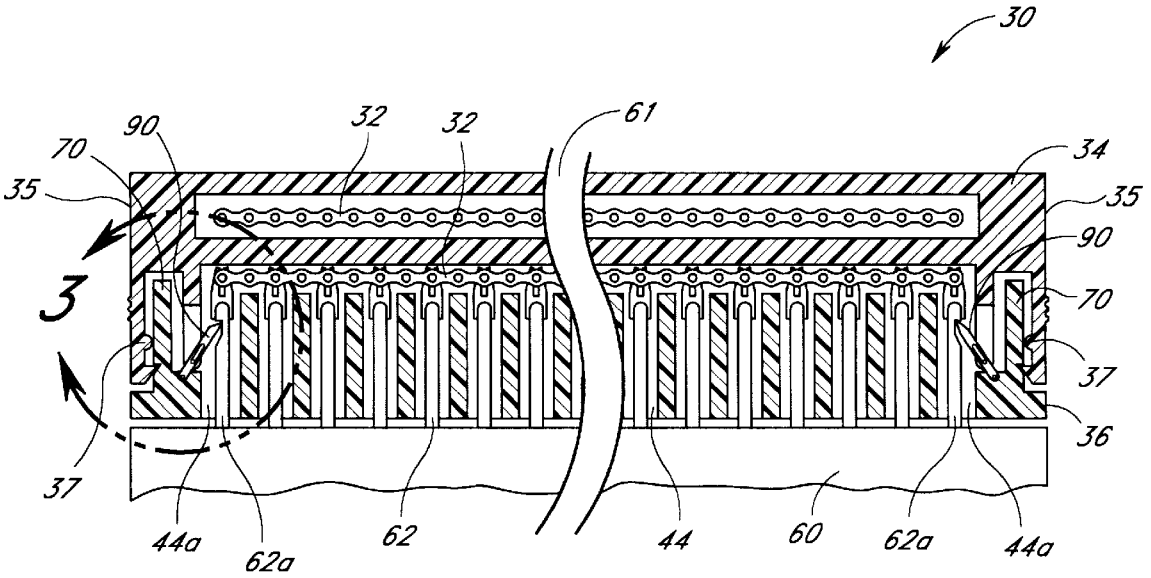
FIG. 2 is a cross-sectional view of the ribbon cable connector of FIG. 1 taken along the line 2—2.

FIG. 2 is a cross-sectional view of the ribbon cable connector 30 taken along the lines 2—2 of FIG. 1. The ribbon cable connector 30 is shown coupled with a hardware device 60 having a plurality of pins 62 that include peripheral pins 62*a*. The pins 62 are shown inserted in the pin slots 44. The ribbon cable connector 30 is symmetric along a center line shown generally as a curved break line 61.

Figure 3:
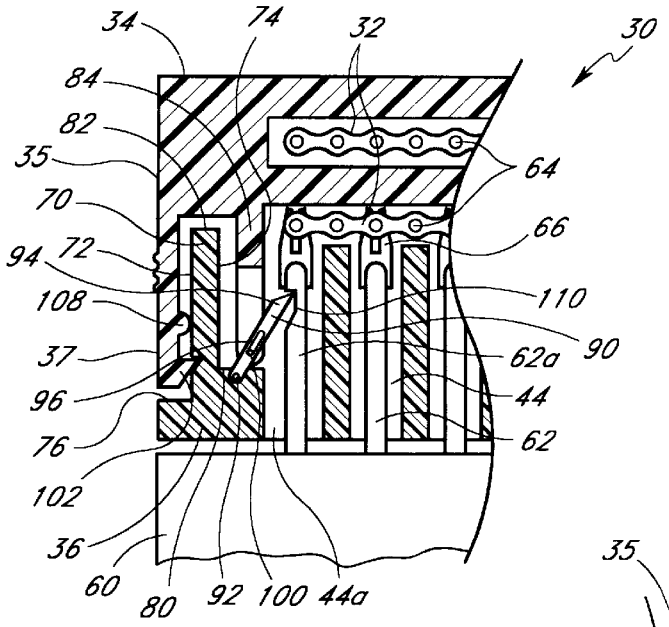
FIG. 3 is an enlarged view of a portion of the ribbon cable connector shown in FIG. 2, illustrating an internal retaining mechanism engaged with a pin device.

FIG. 3 is an enlarged view of a left-side portion of the ribbon cable connector 30. For convenience, the structure and function of the ribbon cable connector 30 will be described in connection with the left side of the ribbon cable connector 30, as is shown in FIG. 3. It will be appreciated that the right side of the ribbon cable connector 30 is a mirror image of the left side and that the following description is equally applicable to both sides of the ribbon cable connector 30.

As shown in FIG. 3, each of the pins 62 communicates with a corresponding wire 64 in the ribbon cable 32 via a connecting rod 66. One connecting rod 66 is mounted within the ribbon cable connector 30 adjacent each of the ends of the pin slots 44 for coupling the pins 62 to the wires 64. Each of the connecting rods 66 includes a set of prongs that are inserted through the ribbon cable 32. The prongs electrically contact the corresponding wire 64 in the ribbon cable 32. In this manner, the ribbon cable 32 electrically couples to the hardware device 60 via the pins 62, the corresponding connecting rods 66, and the respective wires 64.

With reference to FIGS. 2 and 3, a portion of the coupling member 36 is slidably positioned within the housing 34. Specifically, the coupling member 36 includes a peripheral wall 70 that is slidably positioned within the housing 34. As shown in FIG. 3, the peripheral walls 70 has an outer surface 72 adjacent the tab 37 and an inner surface 74 adjacent the peripheral pin slots 44*a*. The outer surfaces 72 extend upward from a lip 76 that abuts the lower end of the tab 37. The inner surface 74 of the peripheral wall 70 forms into an internal step 80 that extend inward toward the pin slots 44.

With reference to FIG. 3, the peripheral wall 70 of the coupling member is slidably positioned within an internal channel 82 in the ribbon cable connector 30. The channel 82 is defined between the inner surface of the tab 37 and a guide wall 84 that extends downward from the pin connector housing 34. The channel 82 is slightly larger than the width of the peripheral wall 70 to facilitate sliding of the peripheral wall 70 within the channel 82. When a user slides the coupling member 36 relative to the housing 34, the peripheral walls 70 slide within the channels 82 in a direction parallel to the direction of the pins 62.

As shown in FIGS. 2 and 3, an internal retaining mechanism comprising a retaining rod 90 is located within the ribbon cable connector 30 for engaging the peripheral pin 62*a* in the hardware device 60, as described in detail below. With reference to FIG. 3, the retaining rod 90 has a first end 92 that is pivotably mounted to the step 80 on the coupling member 36, by a connecting means, such as a rotatable pin connection. A second or engagement end 94 of the retaining rod 90 has a sharpened leading edge and is configured to engage the peripheral pin 62*a* of the hardware device 60, as described more fully below.

As shown in FIG. 3, an elongated hole 96 extends through the retaining rod 90 midway along its length. The elongated hole 96 is sized to receive a small slide pin 100 that is located on the end of the guide wall 84 of the housing 34. The slide pin 100 is configured to slide along the length of the elongated hole 96 when the coupling member 36 is moved relative to the housing 34, as described more fully below.

Figure 5:
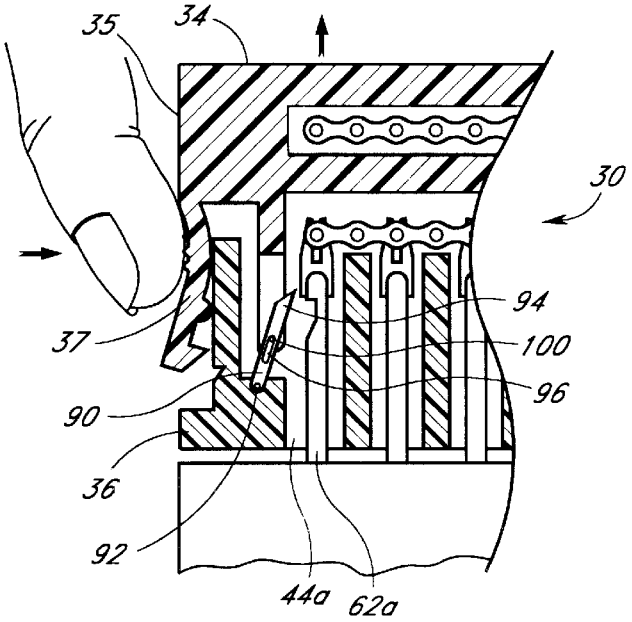
FIG. 5 is an enlarged view of a portion of the ribbon cable connector shown in FIG. 2, illustrating the retaining mechanism released from the pin device.

The retaining rod 90 is movable to a first or engaged position in which the engagement end 94 of the retaining rod 90 extends into the peripheral pin slot 44*a* and engages the peripheral pin 62*a* of the hardware device 60, as is shown in FIG. 3. The retaining rod 90 is also movable to a second or disengaged position in which the engagement end 94 of the retaining rod 90 is disengaged with the peripheral pin 62*a*, as shown in FIG. 5. The movement of the retaining rod 90 between the engaged and disengaged positions is coupled to movement of the coupling member 36 relative to the housing 34, as described more fully below.

As shown in FIG. 3, a ramped extension 102 is located at the lower end of the tab 37 on the housing 34. The ramped extension 102 is sized to engage a corresponding notch 106 (FIG. 4) on the outer surface 72 of the peripheral wall 70 of the coupling member 36. When the ramped extension 102 and the notch 106 are engaged, they inhibit relative movement between the housing 34 and the coupling member 36. Toward this end, the tab 37 is biased so that the ramped extension 102 is urged to remain engaged with the notch 106 until a user manually releases the ramped extension 102 from the notch 106.

Figure 4:
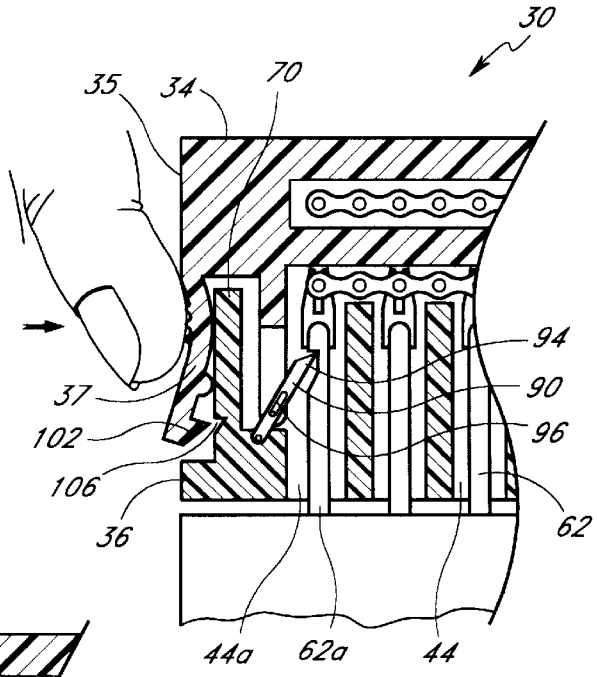
FIG. 4 is an enlarged view of a portion of the ribbon cable connector shown in FIG. 2, illustrating a user releasing the internal retaining mechanism.

As shown in FIG. 3, the inner surface of the tab 37 includes a rounded protrusion 108 that abuts the outer surface 72 of the peripheral wall 70. Referring to FIG. 4, the tab 37 is removed from engagement with the notch 106 by applying an inward force to the tab 37 at a location upward of the rounded protrusion 108, such as with the user's thumb or finger. When such a force is applied, the tab 37 deforms such that the lower portion of the tab 37 moves away from the outer surface 72 of the peripheral wall 70 so that the ramped extension 102 releases from engagement with the notch 106. When the ramped extension 102 is moved out of the notch 106, a user may then slide the coupling member 36 relative to the housing 34.

As mentioned, the retaining rod 90 is movable between two positions. Referring to FIG. 3, in the first or engaged position the retaining rod 90 is oriented at an angle relative to the peripheral wall 70 so that the sharpened engagement end 94 extends into the peripheral pin slot 44*a*. In such a position, the retaining rod 90 engages the peripheral pin 62*a* of the hardware device 60. In particular, the engagement end 94 of the retaining rod 90 is wedged against the peripheral pin 62*a* so as to inhibit the pin 62*a* from sliding out of the peripheral pin slot 44*a*.

In this manner, the retaining rod 90 inhibits the pins 62 of the hardware device 60 from sliding out of the pin slots 44 of the ribbon cable connector 30 by resisting movement of the peripheral pin 62*a* in an outward direction. In the illustrated embodiment, the peripheral pin 62*a* include a small notch 110 (FIG. 3) in which the engagement end 94 of the retaining rod 90 is seated. Such a configuration provides increased resistance to movement between the retaining rod 90 and the peripheral pin 62*a*. In other embodiments, the engagement end 94 of the retaining rod 90 could wedge in a friction engagement against the sides of the pin 62*a* absent the notch 110. The engagement end 94 of the retaining rod 90 could also be provided with serrations to increase the amount of friction between the rod 90 and the pin 62*a*.

The orientation of the retaining rod 90 in the engaged position is configured to inhibit the peripheral pin 62*a* from sliding out of the pin slot 44*a* but not to inhibit the pin 62*a* from sliding into the pin slots 44*a*. Thus, the pins 62 of the hardware device 60 may be inserted into the pin slots 44 even when the retaining rod 90 is positioned in the engaged position. The retaining rod 90 is desirably biased toward the peripheral pin slot 44*a* so that the engagement end 94 automatically engages the peripheral pin 62*a* when inserted into the pin slots 44*a*. If any of the pins 62 start to slide outward, the engagement end 94 of the retaining rod 90 wedges against the side of the peripheral pin 62*a* and prevents all of the pins 62 from further sliding out of the pin slots 44. However, when the pins 62 are inserted into the pin slots 44, the retaining rod 90 does not wedge against the peripheral pin 62*a* due to the orientation of the retaining rod 90.

As mentioned, the retaining rod 90 may also be moved to a disengaged position wherein the retaining rod 90 is released from engagement with the peripheral pin 62*a*. When the retaining rod 90 is disengaged, the pins 62 are freely slidable out of the pin slots. Referring to FIGS. 4 and 5, a user's finger as illustrated moves the retaining rod 90 into the disengaged position as follows. The user first presses inward against the tab 37 so that the tab 37 deforms and the ramped extension 102 on the tab 37 disengages from the notch 106, as described above. With the tab 37 positioned as such, the coupling member 36 is freely slidable relative to the housing 34. The user may then slide the housing 34 outward relative to the coupling member 36, as shown by the upward arrow in FIG. 5.

With reference to FIG. 5, as the housing 34 slides outward from the coupling member 36, the retaining rod 90 begins to pivot along the first end 92. Specifically, as the housing 34 slides outward, the slide pin 100 also moves outward and slides along the elongated hole 96 in the retaining rod 90. The slide pin 100 thus causes the retaining rod 90 to pivot and thereby move to the disengaged position wherein the engagement end 94 of the retaining rod 90 is positioned out of the peripheral pin slot 44*a*. Additionally, the engagement end 94 releases from engagement with the peripheral pin 62*a*. With the retaining rod 90 disengaged, the user may then slide the pins 62 of the hardware device 60 out of the pin slots 44.

If desired, the user may move the retaining rod 90 back to the engaged position after the pins 62 are removed from the pin slots 44. This is accomplished by sliding the housing 34 back over the coupling member 36 until the ramped extension 102 on the tab 37 re-engages the notch 106 in the coupling member 36. As mentioned, the pins 62 may be inserted into the pin slots 44 even when the retaining rod 90 is in the engaged position. The retaining rod 90 may also be kept in the disengaged position until the ribbon cable connector 30 is again coupled with the pins of another hardware device 60. As the user presses the ribbon cable connector 30 onto the pins of the hardware device, the housing 34 slides relative to the coupling member 36 and automatically moves the retaining rod 90 into the engaged position.

It will be appreciated that other mechanisms could be employed in addition to the ramped extensions 102 to keep the retaining rods 90 in the engaged position. For instance, a small spring could be inserted between the housing 34 and the coupling member 36 so that the housing 34 is biased toward the coupling member 36. In this manner, the housing 34 is automatically urged to move the retaining rod 90 into the engaged position after the retaining rod 90 is disengaged and the pins 62 are removed from the pin slots 44.

The ribbon cable connector 30 described herein is used to retain a ribbon cable 32 with the hardware device 60. The internal retaining mechanism inhibits the pins 62 of the hardware device 60 from sliding out of the pin slots 44 in the cable connector 30. The retaining mechanism is easily disengaged when the user desires to remove the pins 62 from the pins slots 44. The ribbon cable connector 30 is advantageous as it may be used in conjunction with existing pin connections without having to revise the existing designs of the pins on the computer device. The ribbon cable connector 30 is easily coupled and uncoupled from the pin device.

Although the foregoing description of the invention has shown, described and pointed out fundamental novel features of the invention, it will be understood that various omissions, substitutions, and changes in the form of the detail of the apparatus and method as illustrated and described, as well as the uses thereof, may be made by those skilled in the art without departing from the spirit of the present invention. Consequently, the scope of the invention should not be limited to the foregoing discussion, but should be defined by the appended claims.

What is claimed is:

1. A method of releasably attaching a ribbon cable to a hardware device, comprising:

attaching the ribbon cable to a ribbon cable connector having an internal retaining mechanism;

inserting a plurality of pins of the hardware device into a plurality of slots defined by the ribbon cable connector; and moving an engagement rod of the internal retaining mechanism at least partially into one of the plurality of slots so as to engage one of the pins, to thereby inhibit the ribbon cable connector from uncoupling from the hardware device.

2. The method of claim 1, wherein moving the engagement rod comprises causing the engagement rod to at least partially move into one of the plurality of slots and engage a peripheral pin in the plurality of pins.

3. The method of claim 1, wherein moving the engagement rod additionally comprises moving the engagement rod into one of the plurality of slots so as to engage a notch on a peripheral pin.

4. The method of claim 1, additionally comprising moving the engagement rod so that the engagement rod disengages from the pin to thereby allow the pin to uncouple from the ribbon cable connector.

5. The method of claim 4, additionally comprising uncoupling the pin from the ribbon cable connector.

6. A method of releasably attaching a ribbon cable to a mating connector having a plurality of pins, on a hardware device, comprising:

attaching the ribbon cable to a ribbon cable connector having at least one slot sized to receive a pin of the mating connector and an internal retaining mechanism moveably attached to the ribbon cable connector and configured to engage the pin when the pin is inserted into the at least one slot;

inserting the pin of the mating connector of the hardware device into the at least one slot on the ribbon cable connector; and actuating the internal retaining mechanism so that the internal retaining mechanism moves with respect to an attachment location so as to at least partially extend into the at least one slot and engage the pin in said at least one slot to thereby inhibit the pin from moving out of said at least one slot.

7. The method of claim 6, wherein inserting the pin of the mating connector into the at least one slot on the ribbon cable connector comprises inserting a plurality of pins of the mating connector into a plurality of slots in the ribbon cable connector.

8. The method of claim 6, additionally comprising actuating the internal retaining mechanism so that the internal retaining mechanism moves with respect to the attachment location so as to at least partially retreat from the at least one slot and disengages from the pin, to thereby allow the pin to move out of the at least one slot in the ribbon cable connector.

9. The method of claim 8, additionally comprising moving the pin out of the at least one slot in the ribbon cable connector.

10. The method of claim 6, wherein actuating the internal retaining mechanism comprises moving a retaining rod of the internal retaining mechanism with respect to the attachment location such that a leading edge of the retaining rod moves into the at least one slot and wedges against the pin.

11. The method of claim 10, additionally comprising engaging the edge of the retaining rod with a notch on the pin.

12. The method of claim 11, wherein engaging the edge of the retaining rod with a notch on the pin comprises wedging the edge of the retaining rod in the notch in the pin.

13. A method of retentively coupling a ribbon cable to a hardware device, comprising:

attaching the ribbon cable to a ribbon cable connector configured to couple to the hardware device, wherein the ribbon cable connector includes a slot dimensioned to receive a male member of the mating connector on the hardware device and an internal retaining rod which is moveably attached to the ribbon cable connector and which is configured to engage the male member when the male member is inserted into the slot;

inserting the male member into the slot so that the internal retaining rod moves with respect to an attachment location and engages the male member to thereby inhibit the male member from moving out of the slot.

14. The method of claim 13, wherein inserting the male member into the slot comprises sliding a pin of the mating connector into the slot.

15. The method of claim 13, additionally comprising moving the internal retaining rod with respect to the attachment location so as to disengage the internal retaining rod from engagement with the male member.

16. The method of claim 15, additionally comprising removing the male member from the slot.

17. The method of claim 13, additionally comprising rotatably moving the internal retaining rod about an attachment location so as to wedge against the male member to inhibit the male member from moving relative to the slot when the male member is positioned in the slot.

18. A method of coupling a ribbon cable to a hardware device, comprising:

attaching the ribbon cable to a ribbon cable connector having a slot sized to receive a male member of a mating connector on the hardware device;

inserting the male member into the slot on the ribbon cable connector;

actuating the ribbon cable connector so that an internal retaining mechanism moveably attached to the ribbon cable connector and located within the ribbon cable connector moves with respect to an attachment location so as to engage the male member to prevent the male member from moving within the slot.

19. The method of claim 18, additionally comprising actuating the ribbon cable connector so that the internal retaining mechanism within the ribbon cable connector moves with respect to the attachment location so as to disengage from the male member to allow the male member to move out of the slot.

20. The method of claim 19, additionally comprising removing the male member from the slot.

* * * * *